US010832557B2

(12) United States Patent
Barson

(10) Patent No.: US 10,832,557 B2
(45) Date of Patent: Nov. 10, 2020

(54) OPERATING A FIRE ALARM SYSTEM

(71) Applicant: Honeywell International Inc., Morris Plains, NJ (US)

(72) Inventor: Michael Barson, Nuneaton (GB)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/381,805

(22) Filed: Apr. 11, 2019

(65) Prior Publication Data

US 2020/0327799 A1 Oct. 15, 2020

(51) Int. Cl.

| | |
|---|---|
| ***G08B 21/00*** | (2006.01) |
| ***G08B 25/01*** | (2006.01) |
| ***G08B 25/04*** | (2006.01) |
| ***G08B 17/10*** | (2006.01) |

(52) U.S. Cl.
CPC ..... *G08B 25/018* (2013.01); *G08B 17/10* (2013.01); *G08B 25/04* (2013.01)

(58) Field of Classification Search
CPC ..... G08B 25/018; G08B 17/10; G08B 25/04
USPC ..... 340/506, 628
See application file for complete search history.

(56) References Cited

U.S. PATENT DOCUMENTS

| | | | | |
|---|---|---|---|---|
| 3,665,461 | A * | 5/1972 | Gnagi | G08B 17/06 340/509 |
| 6,081,197 | A * | 6/2000 | Garrick | G08B 29/181 340/636.1 |
| 2004/0051643 | A1* | 3/2004 | Bullmore | G08B 23/00 340/635 |
| 2006/0214811 | A1* | 9/2006 | Barrieau | G08B 17/10 340/635 |
| 2009/0009352 | A1* | 1/2009 | Savage, Jr. | G08B 29/181 340/663 |
| 2010/0308990 | A1* | 12/2010 | Simon | G08B 29/16 340/506 |
| 2015/0214842 | A1* | 7/2015 | Barson | H05B 45/37 340/538.11 |
| 2015/0254971 | A1* | 9/2015 | Okeefe | G08B 29/126 340/511 |

* cited by examiner

*Primary Examiner* — Mark S Rushing
(74) *Attorney, Agent, or Firm* — Brooks, Cameron & Huebsch, PLLC

(57) ABSTRACT

Devices, systems, and methods for operating a fire alarm system are described herein. One device includes circuitry to determine a resistance associated with an addressable fire alarm loop during a quiescent condition, determine an expected voltage drop in the loop during an alarm condition based on a plurality of devices of the loop, and set an alarm drive voltage of a power supply associated with the loop based on the resistance and the expected voltage drop.

19 Claims, 3 Drawing Sheets

OPERATING A FIRE ALARM SYSTEM

TECHNICAL FIELD

The present disclosure relates to devices, systems, and methods for operating a fire alarm system.

BACKGROUND

A fire alarm system includes a number of devices to detect and/or warn people when smoke, fire, carbon monoxide, and/or other emergencies are present. Warnings may be audio and/or visual warnings, for instance.

Addressable fire alarm systems utilize signaling line circuits (SLCs), which commonly may be referred to as "loops." A loop can include a control panel and a number of fire alarm system devices including, for example, fire detectors and alarm devices. Each fire alarm system device may include a respective loop breaker or isolator, and the length of some loops may be quite long (e.g., several kilometers). Consequently, loop resistance may be considerable. Additionally, if a fire is detected, the control panel goes into alarm state and activates alarm devices, causing an increase in loop current and a significant voltage drop on the loop wiring.

To provide sufficient power in the face of the considerable resistance and to accommodate the significant voltage drop, previous approaches may operate fire alarm systems using a high drive voltage continuously supplied by the control panel. However, such a continuously high drive voltage may cause failures, shorten lifespans of fire alarm system devices, and pose electric shock hazards.

DETAILED DESCRIPTION

Figure 1:
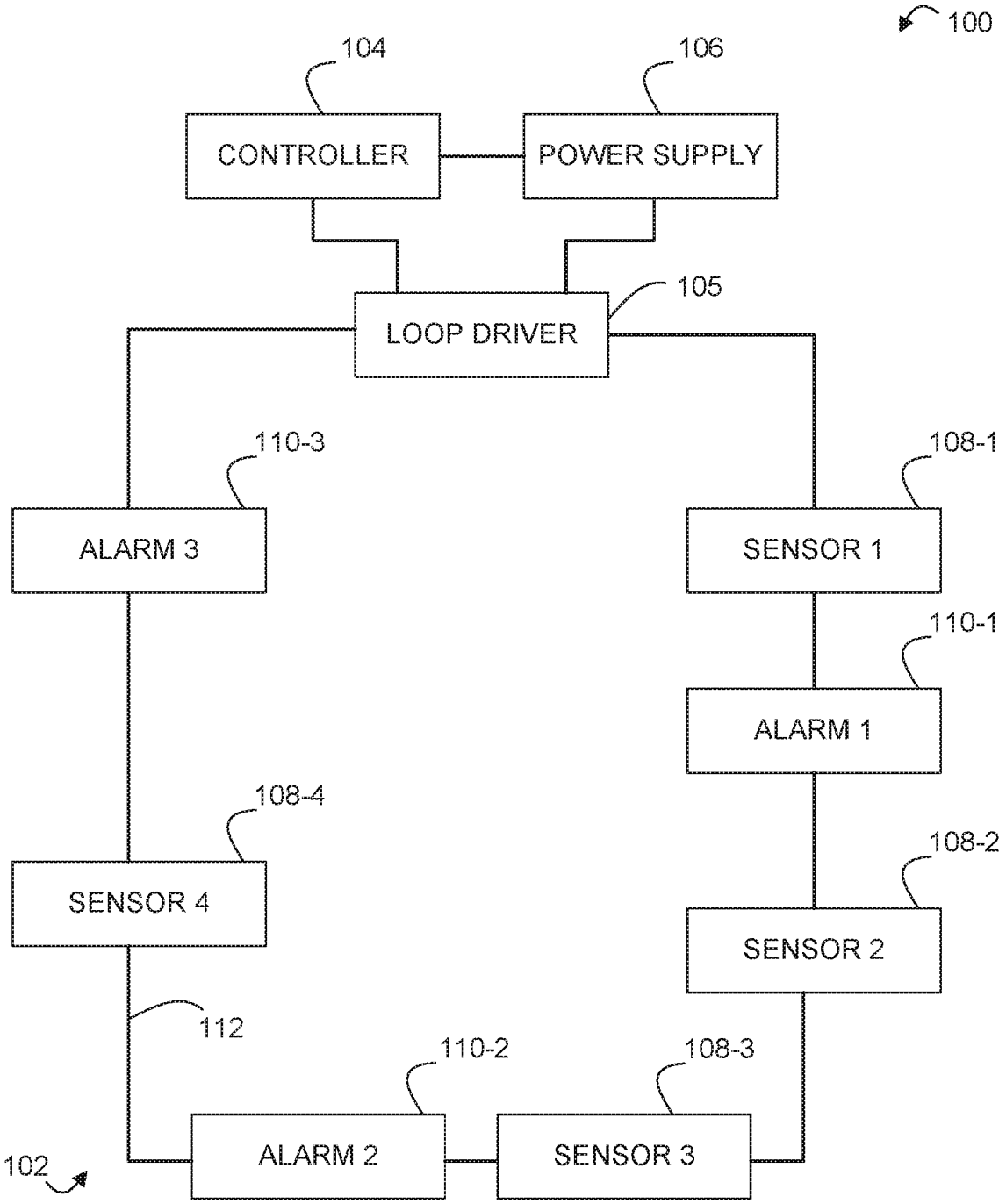
FIG. 1 illustrates a fire alarm system in accordance with one or more embodiments of the present disclosure.

Devices, systems, and methods for operating a fire alarm system are described herein. In some examples, one or more embodiments include a controller comprising circuitry to determine a resistance associated with an addressable fire alarm loop during a quiescent condition, determine an expected voltage drop in the loop during an alarm condition based on a plurality of devices of the loop, and set an alarm drive voltage of a power supply associated with the loop based on the resistance and the expected voltage drop.

Embodiments of the present disclosure can control (e.g., dynamically control) the voltage level of a fire alarm system. More specifically, embodiments herein can control the drive (e.g., working) voltage of an addressable fire alarm loop (sometimes referred to herein simply as "loop"). In some embodiments, such control can be carried out based on system device (e.g., load) current and/or resistance of the loop.

If a fire is detected by a sensor (e.g., smoke detector, heat detector, flame detector, etc.) in a building, the fire alarm system of that building goes into an alarm condition (e.g., alarm state). In the alarm condition, alarm devices of the fire alarm system are activated. In previous approaches, the activation of alarm devices may be carried out instantaneously and/or simultaneously, causing a large increase in loop current and a significant voltage drop on loop wiring. To accommodate the significant expected voltage drop during alarms, previous approaches may operate fire alarm systems using a high drive voltage continuously supplied by the fire alarm system control panel at all times.

In contrast to previous approaches, embodiments herein can supply a variable voltage at a level just high enough so as to accommodate voltage drops and/or resistance. As a result, embodiments herein can avoid issues resulting from continuously high drive voltage such as failures, shortened lifespans of fire alarm system devices, and dangerous electric shock hazards.

For example, for a lightly loaded system having only a few alarms and/or sensors, embodiments herein can determine and/or set an alarm voltage that is barely above a quiescent (e.g., non-alarm) voltage. In contrast, a long loop of two or more (e.g., several) kilometers having a large number (e.g., dozens) of alarms and/or sensors that are not evenly spaced on the loop may exhibit a significant voltage drop in alarm condition (e.g., when alarms are activated). In such a scenario, embodiments of the present disclosure can ramp up loop drive voltage over a period of time to an alarm drive voltage (e.g., a voltage sufficient to operate alarm devices at a particular power). Correspondingly, embodiments herein can ramp up alarm device current over a period of time (e.g., using a soft start) so that the final alarm working voltage is reached before the full alarm current is drawn by the alarm devices.

In addition, embodiments of the present disclosure can determine when maintenance activities are being performed on a fire alarm system and can safeguard people from potential electric shock hazard. For example, when a device is removed or when a panel door is opened, some embodiments can set the alarm voltage to not exceed the quiescent voltage. In some embodiments, the alarm voltage during maintenance activities can be a higher level than the quiescent voltage but lower than the normal alarm voltage. In some embodiments, alarm devices can reduce their current draw (e.g., reduce volume and/or brightness) if the voltage drop on the wiring exceeds the drive voltage. Accordingly, maintenance personnel can be protected from dangerously high voltages while the efficacy of the fire alarm system remains intact.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 302 in FIG. 3.

As used herein, "a" or "a number of" something can refer to one or more such things. For example, "a number of aircraft" can refer to one or more aircraft.

FIG. 1 illustrates a fire alarm system 100 in accordance with one or more embodiments of the present disclosure. As shown in FIG. 1, the system 100 includes a controller (e.g., microcontroller) 104, a loop driver 105, and a power supply 106. The controller 104 can be a portion (e.g., card) of an addressable fire alarm control panel (hereinafter "panel"), for instance. The power supply 106 can be a direct current (DC) voltage source with modulation, for instance, though embodiments herein are not so limited. The loop driver 105 can allow data to be exchanged between the loop 102 (discussed below) and the controller 104. The loop driver 105 can determine resistance associated with the loop 102. Operations of the power supply 106 and/or the loop driver 105 can be controlled by the controller 104. In some embodiments, the fire system 100 can use combined power transmission and digital communications on a screened (e.g., shielded) two-wire loop. In some embodiments, the fire system 100 can use combined power transmission and digital communications on an unshielded cable.

As shown in FIG. 1, the system 100 includes a first sensor 108-1, a second sensor 108-2, a third sensor 108-3, and a fourth sensor 108-4 (sometimes cumulatively referred to as "sensors 108"). It is noted that while four sensors 108 are illustrated in the example shown in FIG. 1, embodiments of the present disclosure are not so limited. The sensors 108 can be heat detectors, smoke detectors, flame detectors, fire gas detectors, water flow detectors, and/or other types of sensing devices known to those of skill in the art.

The system 100 includes a first alarm device 110-1, a second alarm device 110-2, and a third alarm device 110-3 (sometimes cumulatively referred to as "alarms 110"). The alarms 110 can be notification devices, for instance, configured to alert occupants of the need to evacuate or take action in the event of a fire or other emergency. In some embodiments, one or more of the alarms 110 can be audio alarms (e.g., speakers, sirens, etc.). In some embodiments, one or more of the alarms 110 can be visual alarms (e.g., displays, lights, signs, etc.). It is noted that while three alarms 110 are illustrated in the example shown in FIG. 1, embodiments of the present disclosure are not so limited.

The system 100 can include other fire alarm system devices not shown in FIG. 1. For example, the system 100 can include one or more initiating devices (e.g., fire alarm boxes), pull stations, break glass stations, and/or call points. Fire alarm system devices shown in the example illustrated in FIG. 1 (e.g., sensors 108 and alarms 110) and those not shown may cumulatively be referred to as "system devices." System devices in accordance with the present disclosure can have "soft start" characteristics such that they can draw an increasing amount of current over a period of time. System devices in accordance with the present disclosure can have non-linear load characteristics (e.g., if loop voltage drops below a threshold voltage). Though not shown in the example illustrated in FIG. 1, each of the system devices can include a respective breaker (e.g., loop breaker, isolator, circuit breaker, etc.).

The system devices and the controller 104 of system 100 can be communicatively coupled by wiring 112 to form a loop 102. The wiring 112 can carry combined power transmission and digital communications between the system devices and the controller 104. Operations of the system devices can be controlled by the controller 104.

Embodiments of the present disclosure can determine resistance of the loop in a quiescent (e.g., non-alarm or normal) condition. Resistances can be determined continuously. In some embodiments, determining resistance can include determining a resistance of the wiring 112 (e.g., resistance of material(s) of wiring 112). In some embodiments, such a value may be known or accessed from a database.

In some embodiments, determining resistance can include determining a respective resistance of each of a plurality of portions of the loop 102 located between system devices (e.g., resistance of a length of the wiring 112 between each alarm 110). For instance, a current source can be fed into the first alarm 110-1 and the voltage thereof can be determined. Accordingly, the resistance of the device can be determined based on an amount that the determined voltage is pulled down.

In some embodiments, determining resistance can include determining a resistance for each of a plurality of circuit breakers corresponding to the plurality of devices. For instance, a voltage on either side of a breaker (e.g., each leg) can be determined and resistance can be determined based on the difference in voltage.

From the determined resistance(s) and the expected voltage drop when the devices are in alarm condition, embodiments of the present disclosure can determine and/or set an alarm drive voltage of the power supply 106. A value of the alarm drive voltage can be a value that exceeds a level sufficient to accommodate the voltage drops caused by the load current when the devices (e.g., alarms) are activated. Such a level can be exceeded by a small margin (e.g., within 2 Volts). In some embodiments, the value of the alarm drive voltage can be less than a value of a voltage rating of a device (e.g., an alarm) of the plurality of devices. In some embodiments, the value of the alarm drive voltage can be less than a value of a voltage rating of each of the plurality of devices.

The controller 104 can cause the power supply 106 to increase from a quiescent drive voltage to the alarm drive voltage responsive to an occurrence of an alarm condition. In some embodiments, the voltage can be ramped up and/or increase over a particular period of time. In some embodiments, the alarms 110 can be configured to regulate an activation current (e.g., soft start) such that the activation current increases over a period of time.

Figure 2:
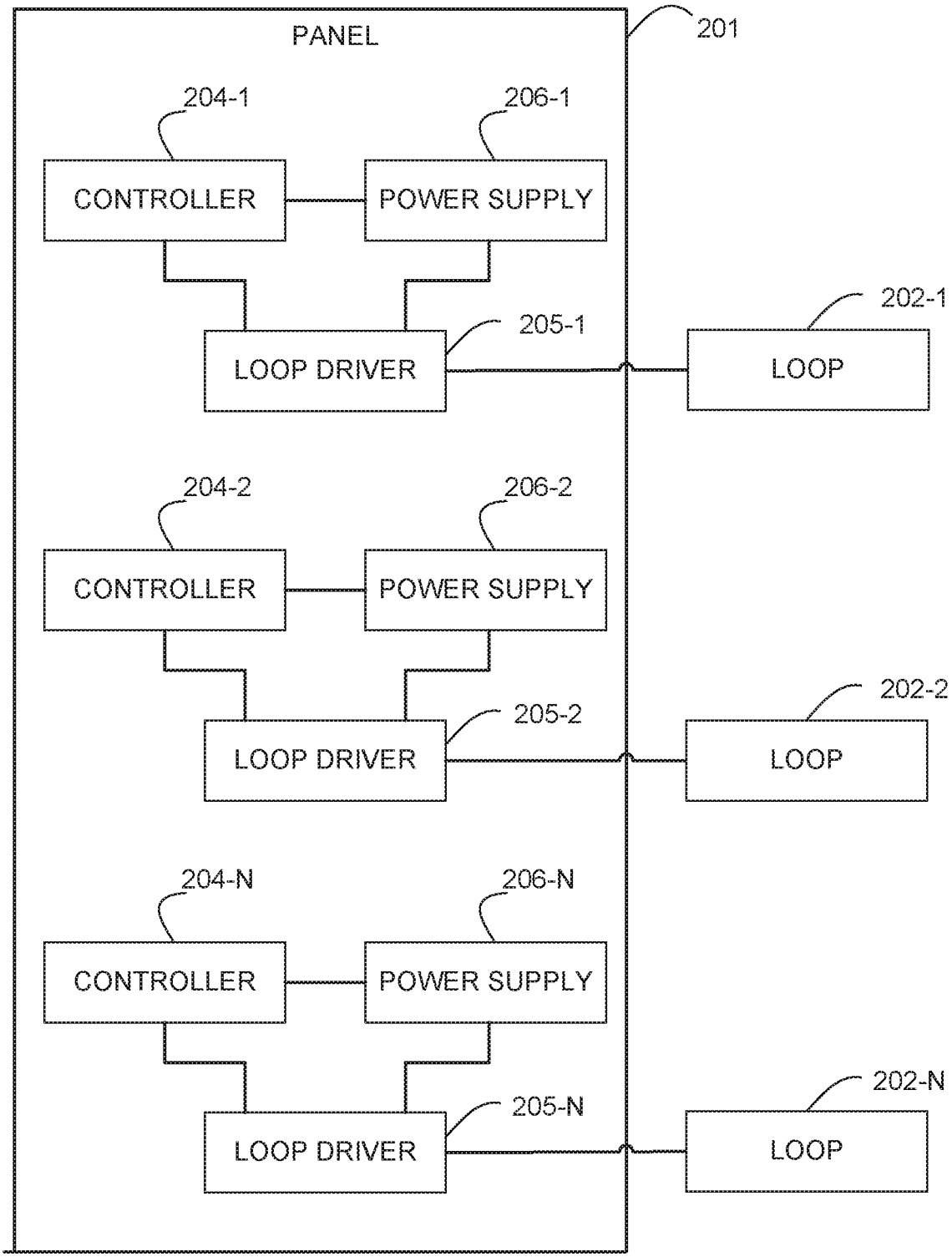
FIG. 2 illustrates another fire alarm system in accordance with one or more embodiments of the present disclosure.

FIG. 2 illustrates another fire alarm system in accordance with one or more embodiments of the present disclosure. As shown in the example illustrated in FIG. 2, the system can include a panel 201 having a number of controllers therein (e.g., a controller 204-1, a controller 204-2, and a controller 204-N). As shown, the controllers 204 can each be associated with a respective power supply (e.g., a power supply 206-1, a power supply 206-2, and a power supply 206-N) and a respective loop driver (e.g., a loop driver 205-1, a loop driver 205-2, and a loop driver 205-N), which can be associated with a respective loop (e.g., a loop 202-1, a loop 202-2, and a loop 202-N).

In accordance with the present disclosure each of the loops 202 can have a different alarm drive voltage (e.g., a different first alarm drive voltage). The differences are due, for example to differing system device types, numbers, and/or configurations in the different loops 202.

Embodiments herein can determine a maintenance condition associated with a loop 202. In an example, the controller 204-1 can determine that a door associated with the panel 201 is open. In another example, the controller 204-1 can determine that an alarm device of the loop 202-1 has been disconnected (e.g., such that base contacts are exposed and electric shock is possible). Upon determining a maintenance condition, one or more of the controllers 204 can set a second (e.g., reduced) alarm drive voltage.

In some embodiments, the second alarm drive voltage can correspond (e.g., be equivalent to) the quiescent drive voltage. In some embodiments, the second alarm drive voltage can be greater than the quiescent drive voltage but less than the first alarm drive voltage. Stated differently, the second alarm drive voltage of the power supply can exceeds the quiescent drive voltage and can be exceeded by the first alarm drive voltage.

In some cases, the second alarm drive voltage may be insufficient to support the load in alarm condition. In such cases, each alarm device can determine a voltage level associated with a portion of the loop wiring adjacent to the alarm device. If that determined voltage level is insufficient to operate the alarm device at full output (e.g., brightness and/or volume), the output and/or current draw of the alarm device can be reduced such that the second alarm drive voltage is sufficient.

Figure 3:
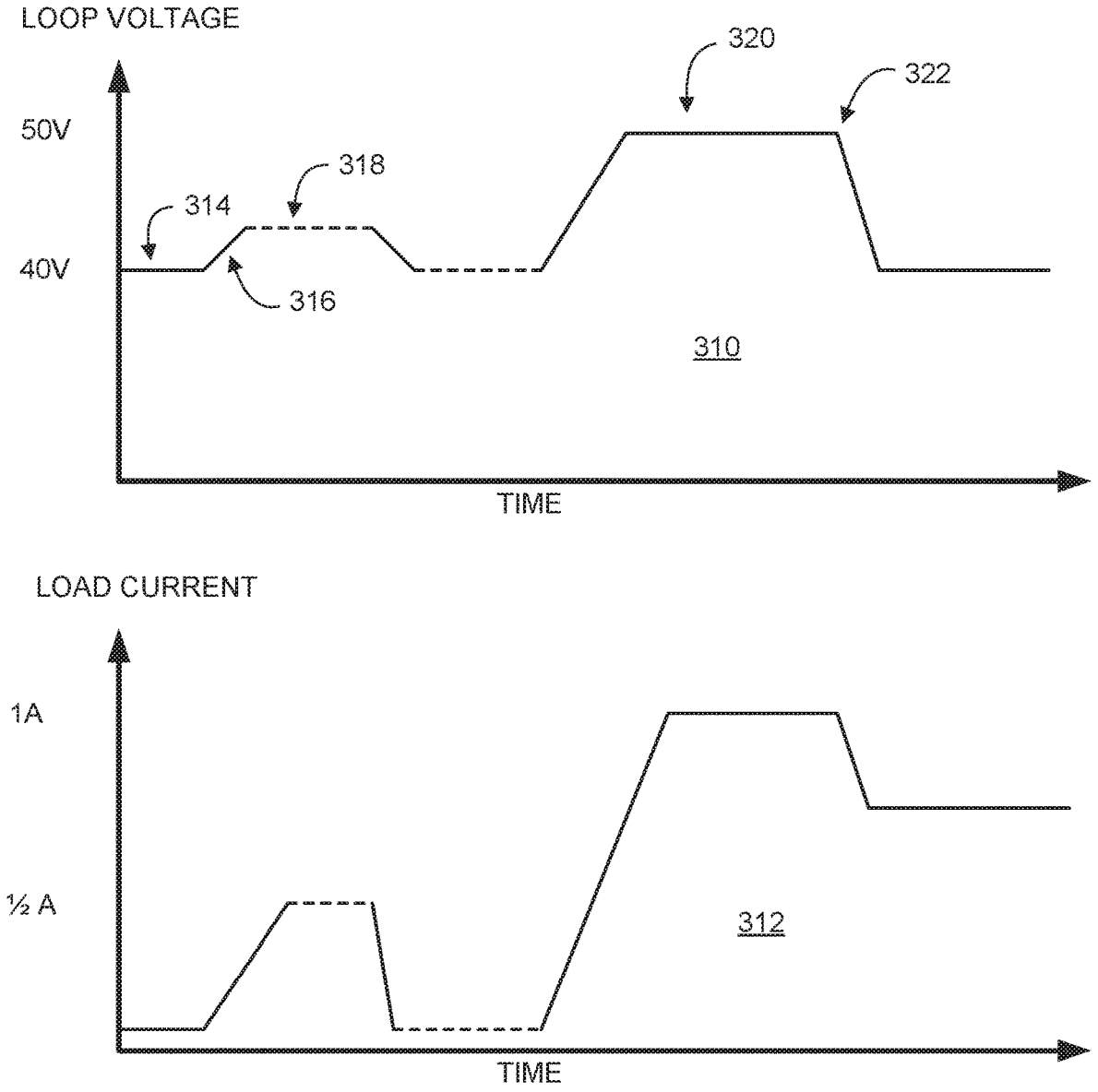
FIG. 3 illustrates a chart of alarm drive voltage and a chart of load current associated with a particular loop under different conditions in accordance with one or more embodiments of the present disclosure.

FIG. 3 illustrates a chart of alarm drive voltage and a chart of load current associated with a particular loop under different conditions in accordance with one or more embodiments of the present disclosure. During quiescent condition 314, the voltage of the loop is at a reduced, quiescent drive voltage of approximately 40 Volts, and the load current is at a reduced state of less than ½ Amperes (e.g., approximately 0.1 Amperes). During an alarm condition, the loop voltage is ramped up over a period of time 316 to an alarm drive voltage of approximately 45 Volts. The load current ramps up over a slightly longer period of time to approximately ½ Amperes as the alarm devices of the loop soft start. The first alarm condition illustrated in FIG. 3 lasts for a period of time 318 before both the loop voltage and the load current return to their quiescent levels.

A second alarm condition causes the loop voltage to ramp up to approximately 50 Volts and causes the load current to ramp up to approximately 1 Amperes for a period of time 320. As seen in FIG. 3, the higher load of the second alarm condition causes a greater increase in the loop voltage than the first alarm condition.

At 322, the example illustrated in FIG. 3 illustrates the effects on loop voltage and load current when a device is disconnected from the loop. While the load current is reduced somewhat (e.g., to a level approximating ¾ Amperes, the loop voltage is reduced back to the quiescent level of approximately 40 Volts.

Embodiments herein can include hardware, firmware, and/or logic that can perform a particular function. For instance, some embodiments include circuitry (e.g., diagnostic circuitry). As used herein, "logic" is an alternative or additional processing resource to execute the actions and/or functions, described herein, which includes hardware (e.g., various forms of transistor logic, application specific integrated circuits (ASICs)), as opposed to computer executable instructions (e.g., software, firmware) stored in memory and executable by a processing resource.

Some embodiments can, in addition to, or in place of, a controller, be performed by a computing device. Computing devices in accordance with the present disclosure can include a memory and a processor. Memory can be any type of storage medium that can be accessed by the processor to perform various examples of the present disclosure. For example, the memory can be a non-transitory computer readable medium having computer readable instructions (e.g., computer program instructions) stored thereon that are executable by processor to determine resistance(s), determine voltage drop(s), and/or set alarm drive voltage(s) in accordance with the present disclosure and as discussed herein. Stated differently, the processor can execute the executable instructions stored in the memory to perform these steps, and others, in accordance with the present disclosure.

Memory can be volatile or nonvolatile memory. Memory can also be removable (e.g., portable) memory, or non-removable (e.g., internal) memory. For example, memory can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory. Memory can be located in the computing device and/or can be located internal to another computing resource (e.g., enabling computer readable instructions to be downloaded over the Internet or another wired or wireless connection).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A controller for operating a fire alarm system comprising circuitry to:

determine a resistance associated with an addressable fire alarm loop during a quiescent condition based on:

a resistance of wiring associated with the loop a respective resistance of each of a plurality of circuit breakers corresponding to a plurality of devices of the loop; and a respective resistance of each of a plurality of portions of the loop located between devices of the plurality of devices;

determine an expected voltage drop in the loop during an alarm condition based on the plurality of devices of the loop; and set an alarm drive voltage of a power supply associated with the loop based on the resistance and the expected voltage drop.

2. The controller of claim 1, including circuitry to determine the resistance associated with the loop continuously during the quiescent condition.

3. The controller of claim 1, including circuitry to determine the expected voltage drop in the loop during the alarm condition based on a respective current associated with each of the plurality of devices of the loop.

4. The controller of claim 1, wherein a value of the alarm drive voltage is less than a value of a voltage rating of a device of the plurality of devices.

5. The controller of claim 4, wherein a value of the alarm drive voltage is less than a value of a voltage rating of each of the plurality of devices.

6. The controller of claim 1, including circuitry to cause the power supply to increase from a quiescent drive voltage to the alarm drive voltage responsive to an occurrence of the alarm condition.

7. The controller of claim 6, including circuitry to cause the power supply to increase from the quiescent drive voltage to the alarm drive voltage over a particular period of time.

8. The controller of claim 1, wherein the controller is a microcontroller associated with the loop, and wherein the controller is a part of an addressable fire alarm system control panel.

9. A fire alarm system, comprising:

a plurality of devices of a loop of the fire alarm system, wherein the plurality of devices includes a plurality of alarm devices;

a power supply associated with the loop;

a controller associated with the loop and having circuitry to:

determine a resistance associated with the loop during a quiescent condition based on:

a resistance of wiring associated with the loop a respective resistance of each of a plurality of circuit breakers corresponding to the plurality of devices; and a respective resistance of each of a plurality of portions of the loop located between devices of the plurality of devices;

determine an expected voltage drop in the loop during an alarm condition based on the plurality of devices; and set an alarm drive voltage of the power supply based on the resistance and the expected voltage drop.

10. The system of claim 9, wherein a length of the loop of the fire alarm system exceeds two kilometers.

11. The system of claim 9, wherein the plurality of alarm devices includes audible alarm devices and visual alarm devices.

12. The system of claim 9, wherein the controller includes circuitry to cause the plurality of alarm devices to activate responsive to a determination of an alarm condition associated with the loop.

13. The system of claim 12, wherein the plurality of alarm devices are configured to regulate an activation current such that the activation current increases over a period of time.

14. A method of operating a fire alarm system, comprising:

determining a resistance associated with an addressable fire alarm loop during a quiescent condition based on:

a resistance of wiring associated with the loop a respective resistance of each of a plurality of circuit breakers corresponding to a plurality of devices of the loop; and a respective resistance of each of a plurality of portions of the loop located between devices of the plurality of devices;

determining an expected voltage drop in the loop during an alarm condition based on the plurality of devices of the loop;

setting a first alarm drive voltage of a power supply associated with the loop based on the resistance and the expected voltage drop;

determining a maintenance condition associated with the loop; and setting a second alarm drive voltage of the power supply based on the determined maintenance condition.

15. The method of claim 14, wherein determining the maintenance condition includes determining a disconnection of a device of the plurality of devices from the loop.

16. The method of claim 14, wherein determining the maintenance condition includes determining an opening of a door associated with a control panel of the fire alarm system.

17. The method of claim 14, wherein the second alarm drive voltage of the power supply corresponds to a quiescent drive voltage of the power supply.

18. The method of claim 14, wherein the second alarm drive voltage of the power supply exceeds a quiescent drive voltage of the power supply and is exceeded by the first alarm drive voltage of the power supply.

19. The method of claim 14, wherein the method includes reducing a current draw of a device of the plurality of devices subsequent to setting the second alarm drive voltage of the power supply.

* * * * *